United States Patent [19]

Oxman

[11] Patent Number: 4,896,366

[45] Date of Patent: Jan. 23, 1990

[54] T-SHIRT BAG CLOSURE

[75] Inventor: Jack Oxman, Newport Beach, Calif.

[73] Assignee: World Manufacturing, Inc., Costa Mesa, Calif.

[21] Appl. No.: 273,411

[22] Filed: Nov. 18, 1988

[51] Int. Cl.[4] ..... B65D 33/16

[52] U.S. Cl. ..... 383/71; 383/8; 24/30.5 S

[58] Field of Search ..... 383/8, 42, 70, 71, 74, 383/72; 24/30.5 S, 555, 563

[56] References Cited

U.S. PATENT DOCUMENTS

| | | | |
|---|---|---|---|
| 2,028,714 | 1/1936 | Burwick | 383/72 |
| 2,981,990 | 5/1961 | Balderree, Jr. | 24/30.5 S |
| 3,822,441 | 7/1974 | Paxton | 24/30.5 S |
| 4,292,714 | 10/1981 | Walker | 24/30.5 S X |
| 4,333,566 | 6/1982 | Holmes | 206/343 |
| 4,361,935 | 12/1982 | Paxton | 24/30.5 R |
| 4,509,231 | 4/1985 | Paxton | 24/30.5 S X |
| 4,694,542 | 9/1987 | Koppe | 24/30.5 S |
| 4,760,624 | 8/1988 | Fish | 24/30.5 S |

*Primary Examiner*—Stephen Marcus
*Assistant Examiner*—Jes F. Pascua
*Attorney, Agent, or Firm*—Loyal M. Hanson; Gordon L. Peterson

[57] ABSTRACT

A closure for a T-shirt bag includes a sheet of material, the sheet of material defining first and second openings in which to place first and second handles of a T-shirt bag in order to restrain the handles for purposes of retaining the T-shirt bag at least partially closed. The first and second openings have substantially identical shapes, each being dimensioned and arranged to receive a portion of each handle. Each opening may include an access opening portion and an interior portion, the access opening portion being dimensioned and arranged to enable a user to pass handles through it into the interior portion. The interior portion of each opening may include first and second channel portions that extend on opposite sides of the access opening, each channel portion receiving a separate one of the handles.

12 Claims, 1 Drawing Sheet

T-SHIRT BAG CLOSURE

BACKGROUND OF THE INVENTION

1. Technical Field

This invention relates generally to bag closures, and more particularly to a new and improved bag closure for a T-shirt bag.

2. Background Information

A T-shirt bag includes a bag portion that serves as a container and two loops of flexible material extending from the bag portion that serve as handles. So configured, the T-shirt bag reminds us of a conventional tank top shirt or undershirt, the bag portion corresponding to the body of the shirt and the loops corresponding to the shoulder straps. We commonly use T-shirt bags made of a strong, thin, plastic material such as polyethylene for carrying such items as groceries, and we do this by simply grasping the uppermost portions of the two loops or handles in one hand.

Grasping the uppermost portions of the two handles in one hand tends to partially close the top of the bag portion, thereby making it less likely that the contents will fall out. But before the handles are grasped in this manner, and after they are released, the top of the bag portion can remain open so that the contents can more readily fall out or be accessible or viewable when we desire otherwise. Consequently, we need a way of keeping the top of the bag portion closed when the handles are not being held.

Although various bag closures exist for securing the top or neck of a conventional plastic bag of the type that has no handles, these closures have certain drawbacks when used with a T-shirt bag. For example, U.S. Pat. No. 3,822,441 to Paxton describes a plastic clip that measures one-inch square. Composed of a flat, springy, plastic material, the clip defines an internal bag-neck-confining aperture and a narrow opening in an edge of the clip that provides access to the aperture. The narrow opening divides the clip into a pair of flexible jaws, and the opening is configured to define three inwardly-extending bag-neck-trapping tongues.

In order to apply a closure such as the Paxton clip to the neck of a plastic bag, the bag neck is twisted or bunched in the hand and applied forcibly through the narrow opening into the bag-neck-confining opening. But doing this to a T-shirt bag can intertwine the handles so that they are not easily grasped. Furthermore, placing the top of the bag portion in the clip completely closes the top, while a partial closing may be all that we desire because of the bulk of the T-shirt bag contents. In addition, typical existing closures may be made from polystyrene with the result that they are more stiff and brittle than preferred.

Consequently, it is desirable to have a new and improved closure for a T-shirt bag that overcomes these concerns.

SUMMARY OF THE INVENTION

This invention solves the problems outlined above with a closure having two openings configured to advantageously grip the handles in a manner such that the handles are less likely to become intertwined. In addition, they are configured so that a user can slide the closure up or down the handles a desired amount to adjust the amount by which the top is closed.

In the case of a full T-shirt bag, the closure keeps the handles close together to prevent the contents from spilling out. In the case of a T-shirt bag that is only partially full, the closure can be slid downwardly toward the bag portion to completely close the top without impairing use of the handles.

Generally, a closure constructed according to the invention includes a sheet of material that defines first and second openings in which to place first and second handles of a T-shirt bag in order to restrain the handles for purposes of retaining the T-shirt bag at least partially closed. The sheet of material may include a composition selected from the group consisting of polyvinyl chloride (PVC), polyethylene terephthalate (PET), polyethylene terephthalate glycol (PETG) polypropylene (PP), and acrylanitrile butadiene styrene polymer (ABS) in order that it be less stiff and less brittle than the styrene composition commonly used for existing bag closures.

Unlike existing bag closures, the first and second openings have substantially identical shapes. The first opening is dimensioned and arranged to receive a first portion of the first handle and a first portion of the second handle while the second opening is similarly dimensioned and arranged to receive a second portion of the first handle and a second portion of the second handle.

In one embodiment, the first opening includes a first access opening portion and a first interior portion. The first access opening portion extends from an entrance located at a peripheral edge of the sheet of material to an inward end located at the first interior portion and, for purposes of advantageously retaining the handles, the first interior portion includes first and second channel portions extending on opposite sides of the first access opening portion from the inward end back toward the peripheral edge.

The user places the handles through the first access opening portion into the first interior portion, separates the handles, and then moves each handle back toward the peripheral edge within a respective one of the first and second channel portions. This keeps the handles separated and secured against undesired movement back out of the first access opening portion, and the second opening is similarly configured.

According to another aspect of the invention, there is provided a container that includes a T-shirt bag having first and second handles and a closure installed on the handles. The closure is in the form of a sheet of material defining first and second openings through which the first and second handles extend in order to restrain the handles for purposes of retaining the T-shirt bag at least partially closed, the first opening being dimensioned and arranged to receive a first portion of the first handle and a first portion of the second handle and the second opening being dimensioned and arranged to receive a second portion of the first handle and a second portion of the second handle.

In line with the above, a method of closing a T-shirt bag according to the invention includes providing a T-shirt bag having first and second handles and a closure in the form of a sheet of material defining first and second openings in which to place first and second handles of the T-shirt bag. The method proceeds by placing a first portion of the first handle and a first portion of the second handle in the first opening and placing a second portion of the first handle and a second portion of the second handle in the second opening. The user may then slide the closure along the first and second handles to a desired position in order to close the bag a desired amount.

Although there exist closures having two openings, such as shown, for example, in U.S. Pat. No. 4,509,231 to Paxton, the openings have different sizes and/or shapes. Such a closure enables a user to choose one of the openings for a particular application instead of having both openings operative as described above for the purpose of closing a T-shirt bag.

The above mentioned and other objects and features of this invention and the manner of attaining them will become apparent, and the invention itself will be best understood, by reference to the following description taken in conjunction with the accompanying illustrative drawings.

DESCRIPTION OF THE PREFERRED EMBODIMENTS

Figure 1:
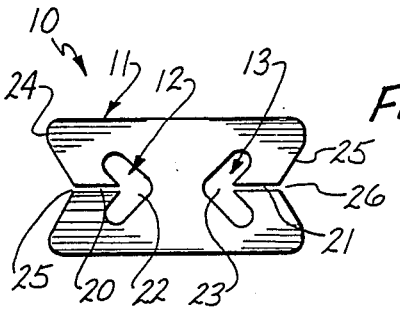
FIG. 1 of the drawings is a plan view of a closure constructed according to the invention.
Figure 2:
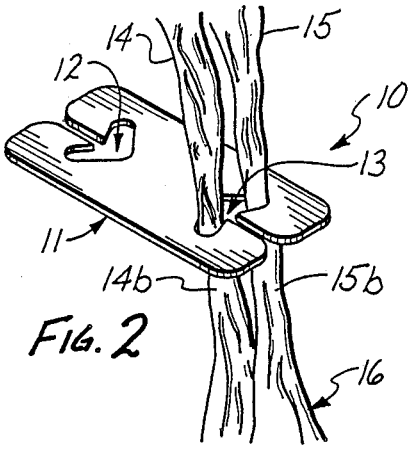
FIG. 2 is an enlarged perspective view the closure installed one side of the two handles of a T-shirt bag.

Referring now to the drawings, there is shown a T-shirt bag closure or closure 10 constructed according to the invention. Generally, the closure 10 includes a sheet of material, (sheet 11 in FIGS. 1–5). The sheet 11 may be about seven-eighths to one inch wide, one and one-half to two and one-half inches long and about twenty-five to fifty mils thick, for example, and be composed of a material such as PVC, PET, PETG, PP, or ABS that is less stiff and less brittle than the styrene commonly used in existing bag closures. Of course, other sizes and compositions may be employed within the broader inventive concepts disclosed.

The sheet 11 defines first and second openings 12 and 13 (FIG. 1) in which to place first and second handles 14 and 15 of a T-shirt bag 16 (FIGS. 2–4), the closure 10 and T-shirt bag 16 together forming a container having a closure. The handles 14 and 15 are placed in the first and second openings 12 and 13 in the sense that portions of the handles are placed within the openings, and this is done to restrain the handles 14 and 15 for purposes of retaining the T-shirt bag 16 at least partially closed.

The first and second openings 12 and 13 have substantially identical shapes as subsequently described. The first opening 12 is dimensioned and arranged to receive a first end or first portion 14A of the first handle 14 and a first end or first portion 15A of the second handle 15. The second opening 13 is similarly dimensioned and arranged to receive a second end or second portion 14B of the first handle 14 and a second end or second portion 15B of the second handle 15.

The closure 10 is installed on the handles 14 and 15 by inserting the first portions 14A and 15A in the first opening 12 and the second portions 14B and 15B in the second opening 13. This is done by sliding the handles 14 and 15 through access opening portion so the openings 12 and 13 to be subsequently described.

Figure 3:
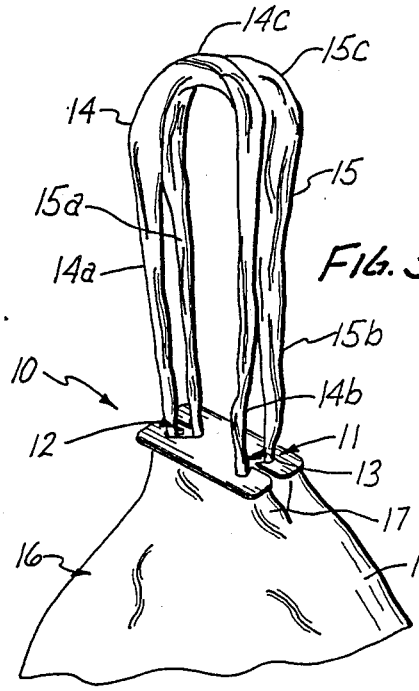
FIG. 3 is a perspective view illustrating the closure installed at the base of both sides of the two handles to fully close the top.
Figure 4:
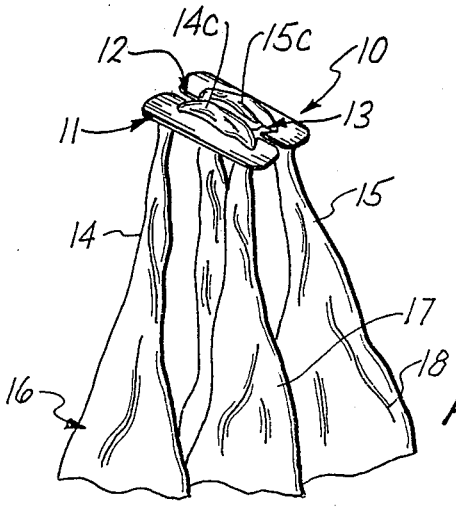
FIG. 4 is a perspective view illustrating the closure after it has been slid to the uppermost portion of the handles for increased bag capacity.

With the closure 10 installed in this way, it can be slid along the handles 14 and 15 between a fully downward position as shown in FIG. 3 and a fully upward position as shown in FIG. 4. In the fully downward position, the closure 10 is fully down the handles 14 and 15 to a top 17 of a bag portion 18 of the T-shirt bag 16. In the fully upward position, it is at uppermost portions 14C and 15C of the handles 14 and 15.

In order to slide the closure 10 toward the fully downward position, the user grasps the uppermost portions 14C and 15C with one hand while sliding the closure 10 downwardly toward the top 17 with the other hand. To slide the closure 10 toward the fully upward position, the user can grasp the handles 14 and 15 at some point between the closure 10 and the top 17 of the bag portion 18 while sliding the closure 10 upwardly toward the uppermost portions 14C and 15C.

To facilitate this process and advantageously grip the handles 14 and 15 in a manner such that the handles are less likely to become intertwined, the first and second openings 12 and 13 are configured to include first and second access opening portions 20 and 21 and first and second interior portions 22 and 23 (FIG. 1). In that regard, the first access opening portion 20 is dimensioned and arranged to enable the user to pass the first portion 14A of the first handle 14 and the first portion 15A of the second handle 15 through it into the first interior portion 22. The second access opening portion 21 is similarly dimensioned and arranged to enable the user to pass the second portion 14B of the first handle 14 and the second portion 15B of the second handle 15 through it into the second interior portion 23.

The sheet 11 includes a circumscribing peripheral edge 24 (FIG. 1) and the first access opening portion 20 extends from a first location 25 at the peripheral edge 24 to the first interior portion 22 while the second access opening portion 21 extends from a second location 26 at the peripheral edge 24 to the second interior portion 23. The first and second handles 14 and 15 are forced through the first and second access opening portions 20 and 21 into the first and second interior portions 22 and 23.

The first and second access opening portions 20 and 21 are sufficiently wide to enable the handles 14 and 15 to be slid through them with little effort, while being sufficiently narrow to restrain the handles 14 and 15 within the first and second interior portions 22 and 23. The illustrated first and second access openings 20 and 21 are about 0.05 millimeters wide for this purpose.

Figure 5:
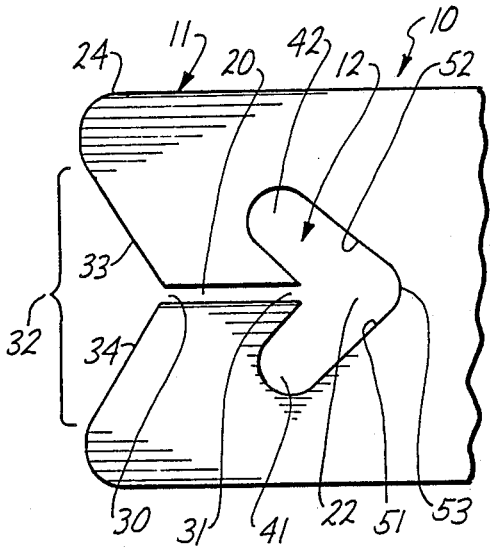

Further details of the closure 10 designed to restrain or grip the handles 14 and 15 are shown in FIG. 5. In that regard, the first and second openings 12 and 13 are generally similar so that only the first opening 12 will be considered.

The first access opening portion 20 extends from an outward end 30 to an inward end 31, the illustrated embodiment being about three-fourths centimeter long. A mouth or entrance 32 is formed by portions 33 and 34 of the peripheral edge 24 inclining about thirty degrees toward the outward end 30 and this helps to feed or guide the handles 14 and 15 into the first access opening portion 20.

The first interior portion 22 is heart-shaped, having first and second channel portions 41 and 42 that extend as illustrated in FIG. 5 on opposite sides of the first access opening portion 20 from the inward end 31 back toward the portions 33 and 34 of the peripheral edge 24. The first portion 14A of the first handle 14 seats within the first channel portion 41 and the first portion 15A of the second handle 15 seats within the second channel 42. This keeps the handles 14 and 15 separated somewhat and it inhibits movement of the handles 14 and 15 back through the inward end 31 into the first access opening portion 20.

For this purpose, each of the channels is sufficiently long to receive the bulk of a respective one of the handles 14 and 15. In addition, this configuration results in first and second surfaces 51 and 52 that cam or guide the handles into the first and second channels 41 and 42. Furthermore, the first and second surfaces 51 and 52 meet at a common point 53 providing a closed interior end of the first interior portion 22. In other words, the first interior portion 22 narrows in a direction away from the inward end 31 and this functions to further confine the handles 14 and 15 and facilitates their placement within respective ones of the first and second channels 41 and 42.

Operationally, according to the method of the invention, the user provides a T-shirt bag having first and second handles and a closure in the form of a sheet of material defining first and second openings in which to place first and second handles of the T-shirt bag.

Then, the user places a first portion of the first handle and a first portion of the second handle in the first opening and then he places a second portion of the first handle and a second portion of the second handle in the second opening.

A closure may be used that is similar to the closure 10 described above. Then, the user passes the first portion of the first handle and the first portion of the second handle through the first access opening portion into the first interior portion. Next, he passes the second portion of the first handle and the second portion of the second handle through the second access portion into the second interior portion. He may then slide the closure along the first and second handles to a desired position in order to close the bag a desired amount.

Thus, this invention solves the problems outlined above with a closure having two openings configured to advantageously grip the handles in a manner such that the handles are less likely to become intertwined. In addition, they are configured so that a user can slide the closure up or down the handles a desired amount to adjust the amount by which the top is closed.

In the case of a full T-shirt bag, the closure keeps the handles close together to prevent the contents from spilling out. In the case of a T-shirt bag that is only partially full, the closure can be slid downwardly toward the bag portion to completely close the top without impairing use of the handles.

Although an exemplary embodiment of the invention has been shown and described, many changes, modifications, and substitutions may be made by one having ordinary skill in the art without necessarily departing from the spirit and scope of the invention.

What is claimed is:

1. A container, comprising:

a T-shirt bag having first and second handles a sheet of material;

the sheet of material defining first and second openings in which to place the first and second handles of the T-shirt bag in order to restrain the handles for purposes of retaining the T-shirt bag at least partially closed;

the first and second openings having substantially identical sizes and shapes;

the first opening being dimensioned and arranged to receive a first portion of the first handle and a first portion of the second handle and the second opening being dimensioned and arranged to receive a second portion of the first handle and a second portion of the second handle;

the first opening including a first access opening portion and a first interior portion, the second opening including a second access opening portion and a second interior portion, the second access opening portion being dimensioned and arranged to enable a user to pass the second portion of the first handle and the second portion of the second handle through the second access portion into the second interior portion;

the sheet of material including a peripheral edge;

the first access opening portion extending to a first location at the peripheral edge of the sheet of material;

the second access opening portion extending to a second location at the peripheral edge;

the first access opening portion including an inward end at the first interior portion; and the first interior portion including first and second channel portions, each of the first and second channel portions extending on an opposite side of the first access opening portion from the inward end of the first access opening portion back toward the peripheral edge.

2. A container as recited in claim 1, wherein:

the first and second access opening portions extend in generally opposite directions toward the first and second locations at the peripheral edge of the sheet of material.

3. A container as recited in claim 1, wherein:

the first and second interior portions are heart-shaped.

4. A container as recited in claim 1, wherein:

the first interior portion narrows in a direction away from the inward end of the first access opening portion.

5. A container as recited in claim 1, wherein the sheet of material includes:

a composition selected from the group consisting of PVC, PET, PETG, PP, and ABS.

6. A container, comprising:

a T-shirt bag having first and second handles;

a closure of sheet material;

the closure having a peripheral edge and first and second openings, each of said openings including an interior portion and an access opening portion, each of said access opening portions extending from the peripheral edge to the associated interior portion and having an inward end at the interior portion, said handles being insertable through the access openings into the interior portions, said closure retaining the T-shirt bag at least partially closed; and said closure including means for restraining the handles against movement in each of the interior portions toward said inward end of the associated access opening portions.

7. A container as recited in claim 6 wherein said restraining means includes means for restraining said handles in the interior portion of the first opening on opposite sides of the inward end of the associated access opening portion.

8. A container as recited in claim 7 wherein said restraining means includes a portion of the perimeter of each of said interior portions.

9. A container as recited in claim 6 wherein said restraining means includes a portion of the perimeter of each of said interior portions.

10. A container as recited in claim 7 wherein said restraining means includes each of the interior portions including first and second channel portions on opposite sides of the inward end of the associated access opening portion and extending in directions to restrain the handles against movement in each of the interior portions toward said inward end of the associated access opening portion.

11. A container as recited in claim 6 wherein the closure has opposite ends and the access opening portions open at said opposite ends, respectively.

12. A container, comprising:

a T-shirt bag having first and second handles;

a closure installed on the T-shirt bag;

the closure including a sheet of material defining first and second openings through which the first and second handles extend in order to restrain the handles for purposes of retaining the T-shirt bag at least partially closed;

the first opening being dimensioned and arranged to receive a first portion of the first handle and a first portion of the second handle and the second opening being dimensioned and arranged to receive a second portion of the first handle and a second portion of the second handle;

the first opening including a first access opening portion and a first interior portion, the first access opening portion being dimensioned and arranged to enable a user to pass the first portion of the first handle and the first portion of the second handle through the first access opening portion into the first interior portion;

the second opening including a second access opening portion and a second interior portion, the second access opening portion being dimensioned and arranged to enable a user to pass the second portion of the first handle and the second portion of the second handle through the second access opening portion into the second interior portion;

each of the first and second access opening portions including an inward end at a respective one of the first and second interior portions;

each of the first and second interior portions including first and second channel portions, each of the first and second channel portions extending on an opposite side of a respective one of the first and second access opening portions from the inward end of the respective access opening portion; and the first portions of the first and second handles being disposed within respective ones of the first and second channels of the first interior portion and the second portions of the first and second handles being disposed within respective ones of the first and second channels of the second interior portion.

* * * * *